US005456850A

United States Patent [19]

Trabitzsch et al.

[11] Patent Number: 5,456,850

[45] Date of Patent: Oct. 10, 1995

[54] FLUID TO PASTY WASHING AGENT CONTAINING BLEACH

[75] Inventors: Uwe Trabitzsch, Ratingen-Homberg; Guenther Amberg, Neuss; Paul Schulz, Wuppertal, all of Germany; Jean-Marie Paillau, La-Celle Saint Cloud, France

[73] Assignee: Henkel Kommanditgesellschaft auf Aktien, Duesseldorf, Germany

[21] Appl. No.: 690,897

[22] PCT Filed: Dec. 5, 1989

[86] PCT No.: PCT/EP89/01487

§ 371 Date: Aug. 14, 1991

§ 102(e) Date: Aug. 14, 1991

[87] PCT Pub. No.: WO90/06986

PCT Pub. Date: Jun. 28, 1990

[30] Foreign Application Priority Data

Dec. 14, 1988 [DE] Germany ..... 38 42 007.4

[51] Int. Cl.[6] ..... C11D 9/00; C11D 9/06

[52] U.S. Cl. ..... 252/97; 252/94; 252/99; 252/102; 252/559; 252/174.16; 252/174.24; 252/174.25; 252/DIG.16

[58] Field of Search ..... 252/94, 97, 99, 252/102, 559, DIG.14, 174.16, 174.24, 174.25

[56] References Cited

U.S. PATENT DOCUMENTS

| | | | |
|---|---|---|---|
| 3,875,070 | 4/1975 | von Praun et al. | 252/97 |
| 3,897,347 | 7/1975 | Eckert et al. | 252/8.75 |
| 3,989,634 | 11/1976 | Prochazka et al. | 252/89 R |
| 4,289,642 | 9/1981 | Weber et al. | 252/99 |
| 4,457,856 | 7/1984 | Mitchell et al. | 252/166 |
| 4,661,281 | 4/1987 | Seiter et al. | 252/140 |
| 4,690,771 | 9/1987 | Ouhadi et al. | 252/102 |
| 4,743,394 | 5/1988 | Kaufmann et al. | 252/90 |

FOREIGN PATENT DOCUMENTS

| | | | |
|---|---|---|---|
| 9013623 | 11/1990 | WIPO | 252/559 |

*Primary Examiner*—Gary P. Straub
*Assistant Examiner*—Timothy C. Vanoy
*Attorney, Agent, or Firm*—Ernest G. Szoke; Wayne C. Jaeschke; Real J. Grandmaison

[57] ABSTRACT

The invention relates to a fluid to pasty, phosphate-free washing agent, containing, based on the washing agent, (A) a tenside component of 20 to 35% w/w which comprises (A1) 1 to 4% w/w of anionic tensides of the class of sulphonates and soaps, (A2) 16 to 34% w/w non-ionic tensides with a setting point of, at the highest, 10° C., (B) 10 to 35% w/w builder salts which are either complexing or which bind alkaline earth metal ions, (C) 15 to 40% w/w sodium metasilicate, (D) 8 to 25% w/w bleaching per-salts, (E) up to 15% w/w other washing agent ingredients, (F) less than 3% w/w water, with the proviso that the sum of components B+C=30 to 60% w/w.

15 Claims, No Drawings

FLUID TO PASTY WASHING AGENT CONTAINING BLEACH

The invention relates to a phosphate-free, fluid to pasty washing agent, which, in view of its particular tenside content, its strongly alkaline, phosphate-free builder component and its bleach content, is particularly intended for use in industrial laundries.

Pasty washing agents which are substantially free of water and which contain bleaching per-compounds are known. In DE 12 79 878 (GB 12 05 711) a pasty agent is described, the liquid phase of which consists of non-ionic tensides and lower alcohols. Sodium tripolyphosphate (TPP) and soda are used as builder salts and sodium perborate monohydrate is used as a bleaching agent. To avoid separation of the pastes in storage, the solids are finely ground and additional suspension stabilisers in the form of finely divided silicic acid are added to the agent. Washing pastes are known from DE 22 33 771 (U.S. Pat. No. 3,850,831) which contain mixtures of non-ionic tensides and polyhydric alcohols as a liquid phase and phosphates, citrate and nitrilotriacetate as builder salts. Water glass, i.e. a weakly alkaline silicate consisting of $Na_2O:SiO_2$=1:3.3 may also be present. Perborate is a possible per-compound.

EP 30 096 teaches that the solids, consisting of builder salts and per-salts, must be ground to a particle size of less than 10 μm in order to avoid separation of the paste during storage. The builder salts consist primarily of polyphosphates. Metasilicates and organic builder salts may also be present, but no further details are provided about this. The tenside component consists solely of liquid non-ionic tensides. Anionic tensides are not present in the pastes. The agents are not satisfactory for the strict requirements of industrial laundries with regard to optimal washing results with widely varying degrees of soiling using washing times which are as short as possible in order to make good use of the expensive washing plant.

In this respect the present invention makes possible a substantial improvement. Care had to be taken that the agents foam as little as possible both during washing and in subsequent rinsing, as a high degree of foam development not only leads to operational breakdowns caused by effluent liquor, but also produces worse washing results, as a large foam cushion suppresses the necessary mechanical treatment of the goods being washed. Furthermore, in the interests of minimizing pollution by the waste water, substantial freedom from phosphates is desirable. Compared with agents containing phosphates however, P-free washing agents require a changed overall concept in order to avoid a drop in the cleaning effectiveness. With powdered washing agents this development is quite far advanced, while with pasty agents the problems are much greater because of the limited selection of usable raw materials. For industrial use however liquid or pasty agents are preferable as they allow automatic metering.

The following invention presents one way of advantageously solving the recited problems.

The invention provides a fluid to pasty phosphate-free washing agent with the following content, in each case based on the washing agent:

(A) A tenside component of 20 to 35% w/w which comprises (A1) 1 to 4% w/w anionic tensides from the class of sulphonates and soaps, (A2) 16 to 34% w/w non-ionic tensides with a setting point of, at the highest, 10° C., (B) 10 to 35% w/w builder salts which are either complexing or which bind alkaline earth metal ions, (C) 15 to 40% w/w sodium metasilicate, (D) 8 to 25% w/w bleaching per-salts, (E) up to 15% w/w other washing agent components, (F) less than 3% w/w water, with the proviso that the sum of the components B+C=30 to 60% w/w.

Suitable ingredients of the tenside component A1 are alkyl benzene sulphonates with linear alkyl chains of 10 to 13 C-atoms, alkane sulphonates with 12 to 16 C-atoms, such as can be obtained by sulphochloridation or sulphoxidation of n-paraffins with subsequent conversion to the alkali salts, and alpha-sulphonated fatty acid esters and fatty acid salts derived from saturated $C_{12-18}$-fatty acids and from $C_{1-4}$-alcohols, preferably methyl alcohol. Preferred sulphonate tensides are alkyl benzene sulphonates.

Further suitable ingredients are soaps from saturated or singly unsaturated $C_{12-22}$-fatty acids, particularly $C_{12-18}$-fatty acids and fatty acid mixtures, for example from cocinic, stearic or colza oil fatty acids.

Tensides of the group A1 are present as alkali salts, preferably as sodium salts. Their proportion, based on the agent, is preferably 1.5 to 3% w/w. Mixtures of alkyl benzene sulphonate and soaps have proved to be particularly suitable, in which case the agent contains 1 to 2.8% w/w alkyl benzene sulphonate and 0.2 to 1.5% w/w soaps. It has surprisingly become apparent that the alkyl benzene sulphonates raise the washing strength of the agent quite considerably, compared with that of an exclusively non-ionic formulation, in spite of their small proportion in the entire tenside component. On the other hand the presence of the sulphonate tensides, which are known to be very active foam producers, does not lead to a troublesome increase in foaming during use.

The component A2 consists of alkoxylated linear alcohols, preferably ethoxylated, or mixtures thereof with alcohols methyl-branched in the 2-position (oxo-alcohols) having 10 to 18 C-atoms, those with 18 C-atoms being for the most part singly unsaturated, i.e. consisting mainly of oleyl alcohol. The number of ethylene glycol ether groups (EO) is 2 to 10, preferably 3 to 8, and should be adjusted together with the remaining alcohol so that the ethoxylates or ethoxylate mixtures have a setting point of, at the highest, 10° C., preferably below 8° C. Alcohol alkoxylates of the general formula $R—(PO)_x—(EO)_y$ are also of particular use, where PO stands for a propylene glycol ether residue, x is the number 1 or 2, and y is a number from 3 to 10. Non-ionics of this class which are particularly suitable are $C_{10-14}$-Coconut alcohols with 3–8 EO, oleyl alcohol with 5–10 EO, or with 1–2 PO and 4–8 EO, $C_{10-14}$-oxoalcohols with 3–8 EO and $C_{12-15}$-oxoalcohols with 3–7 EO, and mixtures thereof.

The proportion of the tenside component A2 in the agent is 16 to 34% w/w, preferably 18 to 30% w/w. The total amount of tensides is 20 to 35% w/w, preferably 22 to 33% w/w.

The component B consists of water-soluble or water-insoluble builder substances capable of binding or sequestering alkaline earth metal ions and, if required, heavy metal ions.

Suitable water-insoluble builder substances are hydrated, finely crystalline, synthetic zeolites of the NaA sort. Suitable zeolites have almost no particles larger than 30 μm and preferably consist of particles at least 80% of which are of a size smaller than 10 μm. Their calcium binding ability, determines as in DE 24 12 837, is of the order of 100 to 200 mg CaO/g. In the interest of having a paste of sufficient fluidity, the amount of zeolites in the agent should preferably not exceed 25% w/w. more preferably 20% w/w.

Particularly suitable builder substances as required for the component B are polyanionic organic complexing agents, used either alone or together with the above mentioned zeolites, whose proportion is preferably 10 to 20% w/w altogether. Suitable are the sodium salts of nitrilotriacetic acid (NTA) and of polyphosphonic acids such as ethylene diamine tetramethylene phosphonic acid (EDTMP), diethylene triamine pentamethylene phosphonic acid (DTPMP), amino trimethylene phosphonic acid (ADTMP) and, in particular. 1-Hydroxyethane-1, 1-diphosphonic acid (HEDP). The agent preferably contains 3 to 8% w/w NTA (Na salt) and 0.5 to 4% w/w HEDP (Na salt). Polymeric or co-polymeric carboxylic acids in the form of sodium or potassium salts also belong to this component, the sodium salts being preferred. Suitable homopolymers are polyacrylic acid, polymethacrylic acid and polymaleic acid. Suitable co-polymers are those of acrylic acid with methacrylic acid or co-polymers of acrylic acid, methacrylic acid or maleic acid with vinyl ethers, such as vinyl methyl ether or vinyl ethyl ether, or with vinyl esters such as vinyl acetate or vinyl propionate, acrylamide, methacrylamide or with ethylene, propylene or styrene. In such co-polymeric acids, in which one of the components exercises no acidic function, that component should not amount to more than 60 mol per cent and should preferably be less than 50 mol per cent, in the interest of sufficient water solubility. Copolymers of acrylic acid or methacrylic acid with maleic acid have proved to be particularly suitable, as characterised for example in EP 25 551-B 1. These are copolymerisates having 50 to 90% w/w acrylic acid or methacrylic acid and 50 to 10% w/w maleic acid. Copolymers having 60 to 85% w/w acrylic acid and 40 to 15% w/w maleic acid are particularly preferred. The amount of the agent made up of these (co)polymers, as their sodium salts, is up to 10% w/w, preferably 3 to 8% w/w.

The component C consists of sodium metasilicate, with an $Na_2O:SiO_2$ ratio of 1:0.8 to 1:1.5, preferably 1:0.9 to 1:1.1. The sodium silicate is used as an anhydrous salt. It preferably amounts to 20 to 35% w/w.

Per-salts or perhydrate salts, such as sodium perborate tetrahydrate, sodium perborate monohydrate and sodium percarbonate, may be used as component D. Sodium perborate monohydrate is preferably used. The agent contains 8 to 25% w/w, preferably 10 to 20% w/w, of such percompounds.

The component E includes known non-ionic or anionic polymers which inhibit greying. Cellulose ethers such as sod/urn carboxymethylcellulose and mixtures thereof with other cellulose ethers such as methylcellulose, ethylcellulose, hydroxyethylcellulose, hydroxypropylcellulose or mixed ethers such as methyl-hydroxyethylcellulose, methylcarboxymethylcellulose or ethyl-hydroxyethylcellulose are particularly suitable. Cellulose ethers and (co)polymers may advantageously be used in combination. Mixtures of carboxymethylcellulose with methylcellulose or methyl-hydroxyethylcellulose have proved to be particularly useful. The agent contains up to 3% w/w, preferably 0.5 to 2% w/w, of such greying inhibitors.

Other ingredients of the component E which are non-tenside or do not act as builder substances may be enzymes, aromatic substances and standard optical brighteners, particularly optical brighteners with an affinity for cellulose fibres (cotton) from the class of substituted bis-triazinylstilbene disulphonic acids and of sulphonated distyryls, which are commonly used in proportions of 0.05 to 0.5% w/w.

In addition, agents for improving the fluidity may be added to the pastes. These include known hydrotropes such as the sodium salts of alkylbenzosulphonates with 1 to 3 C-atoms in one or two alkyl chains, such as toluene sulphonate, cumene sulphonate or xylene sulphonate. Solvents can also be used, such as lower alcohols and ether alcohols or polyethylene glycols with a molecular weight of 200 to 1,000. The polyglycols may constitute up to 10% w/w. Alcohols may be used in the same proportion, but are less preferred.

The water content of the agent should be as low as possible, as free water increases the viscosity of the agent and thus renders the processing and metering of the agent more difficult. Water contents of 2% w/w or less are thus particularly preferred.

The agents are manufactured by mixing and homogenising the solid, finely particulate components with the liquid non-ionic tensides (component A2), particularly with the liquid tenside mixture (component A). Surprisingly, it was observed that about half of the solid alkylbenzene sulphonate content also behaves as a liquid component and thus facilitates the admixture of high solid contents. It is best subsequently to grind the mixture, for example in a colloid mill or roller mill, so that the particle size of the suspended solids lies between 5 and 80 μm, preferably between 10 and 50 μm. The amount of coarse particles (greater than 80 μm) should preferably be less than 20% w/w, and in particular be less than 5% w/w.

The agents are generally used in a concentration of 4 to 12 g/l, preferably 5 to 10 g/l, and softened water, i.e. water which has been reduced to a hardness of less than 2° dH, in particular less than 1° dH, is suitably used for preparing the washing liquor.

The agents are characterised by a high washing and bleaching strength and by low and innocuous foam development during use. Surprisingly, the agents have proved to be exceptionally stable with respect to loss of oxygen and separation, even when stored for long periods of time in changing climatic conditions. Because of their useful rheological properties, they are well suited for use in automatic metering devices, because when subjected to shearing forces they have a low viscosity and are easily propelled, but when at rest they have a higher viscosity and are thus more storage-stable.

EXAMPLES

The composition of the agent may be taken from Table 1, where

ABS=sodium salt of a linear $C_{10-13}$-alkylbenzenesulphonic acid (mean alkyl-chain length $C_{11.8}$)

Soap=sodium soap of hydrated stearic fatty acids

CA-3EO=coconut alcohol $C_{12-14}$ with 3EO

OA-3EO=oxoalcohol $C_{12-15}$ with 3EO

OA-6EO=oxoalcohol $C_{12-15}$ with 6EO

OA-7EO=oxoalcohol $C_{12-15}$ with 7EO

CO-1/6=cetyl-oleyl alcohol containing 55% oleyl alcohol+1 PO+6EO

The metasilicate had the composition $Na_2O:SiO_2$=1:1. The perborate was used in the form of the monohydrate. The copolymer was composed of acrylic acid and maleic acid (3:1) and had a molecular weight of approx 70,000. The cellulose ether consisted of a 2:1 mixture of sodium carboxymethylcellulose and methylhydroxyethylcellulose (hydroxyethyl content 0.8% w/w). The sodium salt of 4,4'-Bis-(2-anilino-4-morpholino-1,3,5-triazin-6-yl-amino)-stilbene-2,2'-disulphonic acid was used as an optical brightener. The water came from the fluid content of the raw materials used. Polydiol was a polyethyleneglycol of molecular weight 400. The amounts given in the table signify percentages by weight.

TABLE 1

| Component | Ingredient | Example 1 | 2 | 3 | 4 | 5 |
|---|---|---|---|---|---|---|
| A1 | ABS | 2 | 2 | 2 | 2.2 | 1.8 |
| | Soap | 0.4 | 0.4 | 0.4 | 0.3 | 0.6 |
| A2 | OA-6EO | 17.5 | — | — | — | — |
| | OA-3EO | 2.5 | — | 10 | 10 | — |
| | OA-7EO | — | — | 20 | 20 | — |
| | CA-3EO | — | — | — | — | 20 |
| | CO-1/6 | — | 30 | — | — | 5 |
| B | Zeolite | — | — | — | 20 | 15 |
| | NTA | 5 | 5 | 5 | — | 3 |
| | HEDP | 2.5 | 2.5 | 2 | 2.5 | 2 |
| | Copolymer | 7.5 | 7.5 | 8 | 7.5 | 5 |
| C | Metasilicate | 32.2 | 30.2 | 30.3 | 15.2 | 35 |
| D | Perborate | 20 | 20 | 20 | 15 | 10 |
| E | Cellulose-ether | 2 | 2 | 2 | 2 | 2 |
| | Brightener | 0.3 | 0.3 | 0.2 | 0.3 | 0.3 |
| | Polydiol | 8 | — | — | 5 | — |
| F | Water | 0.1 | 0.1 | 0.1 | 0.1 | 0.3 |

The stability of the active oxygen and the tendency to separate were tested under various storage conditions, namely:

a) at 22° C. room temperature, b) in a climatised chamber at 30° C. and 80% relative humidity, c) at a climate alternating between +40° C. and −10° C.

In all cases the active oxygen content of the test samples after 8 weeks was 100% of the initial value. There was no separation.

Washing Tests

A washing machine (type Frista®) was loaded with slightly soiled bulk laundry (bed and table linen after single use) and test cloths charged with the following soiling:

S1 Dust and wool-fat on cotton,

S2 Blood on cotton,

S3 Drinking chocolate on cotton,

S4 Dust and skin fat on refined cotton,

S5 Dust and skin fat on mixed textile of refined cotton and polyester,

S6 Dust and wool-fat on mixed textile (as S5),

S7 Red wine on cotton,

S8 Tea on cotton.

The amount washed was 7.5 kg, water hardness was 0 dH, standard program (no pre-wash), washing agent concentration 4 g/l, 5 minutes at 40° C. and 15 minutes at 90° C., three rinses.

The percentage remission (compared with a white standard) was evaluated photometrically. The numerical values rare averages from 3 parallel determinations (variance 2%). The results are collated in the following Table 2.

For comparison V, a similarly composed, pasty washing agent of commerce was tested which contained no anionic tensides.

TABLE 2

| Soiling | % Remission 1 | 2 | 3 | 4 | V |
|---|---|---|---|---|---|
| S1 | 76.4 | 81.1 | 80.3 | 77.1 | 71.7 |
| S2 | 56.1 | 62.6 | 58.1 | 58.2 | 45.8 |
| S3 | 85.2 | 86.0 | 85.5 | 83.5 | 80.6 |
| S4 | 81.5 | 80.6 | 80.2 | 81.2 | 80.4 |
| S5 | 71.3 | 72.0 | 75.5 | 72.1 | 70.2 |
| S6 | 76.4 | 80.2 | 78.3 | 75.3 | 70.1 |
| S7 | 82.5 | 83.2 | 82.8 | 81.8 | 80.6 |
| S8 | 80.1 | 83.0 | 80.5 | 79.8 | 78.3 |

Table 2

In all cases there was little development of foam, i.e. the foam level during the main wash was at most 8 to 10 cm above the surface of the liquid and in the first rinse 4 to 6 cm above the surface of the liquid. In the third rinse there was no longer any visible foam production.

We claim:

1. A phosphate-free washing composition in liquid to paste form, consisting essentially of:

(A) about 20 to about 35% by weight of a tenside component which comprises (A1) about 1 to about 4% by weight of an anionic tenside selected from the group consisting of a sulphonate and a soap, (A2) about 16 to about 34% by weight of a nonionic tenside having a maximum setting point of about 10° C.;

(B) about 10 to about 35% by weight of a builder salt which is capable of complexing or binding alkaline earth metal ions;

(C) about 15 to about 40% by weight of sodium metasilicate;

(D) about 8 to about 25% by weight of a per-salt bleaching agent;

(E) up to about 15% by weight of conventional detergent ingredients; and (F) less than about 3% by weight of water, with the proviso that the sum of components B+C is equal to about 30 to about 60% by weight, all weights being based on the weight of said composition.

2. A composition as in claim 1 wherein component (A1) is present in the amount of from about 1.5 to about 3% by weight.

3. A composition as in claim 1 wherein component (A1) comprises from about 1 to about 2.8% by weight of a $C_{10-13}$-alkylbenzene sulphonate and about 0.2 to about 1.5% by weight of a $C_{12-22}$-fatty acid soap.

4. A composition as in claim 1 wherein component (A2) comprises from about 18 to about 30% by weight of an alkoxylated, saturated or singly unsaturated, linear or 2-methyl-branched $C_{10-18}$-alcohol containing about 2 to about 10 ethylene glycol ether groups, or a mixture thereof.

5. A composition as in claim 4 wherein said component (A2) has a setting point of below 8° C.

6. A composition as in claim 1 wherein said component (B) comprises up to about 25% by weight of a finely crystalline zeolite of the NaA type.

7. A composition as in claim 1 wherein said component (B) contains from about 10 to about 20% by weight of said salt selected from the sodium salt of nitrilotriacetic acid, the sodium salt of 1-hydroxy-ethane-1, 1-diphosphonic acid, and the sodium salt of the copolymer of acrylic acid and maleic acid.

8. A composition as in claim 1 wherein said component (C) is present in the amount of about 20 to about 35% by weight, and has the composition $Na_2O:SiO_2$=1:0.9 to 1:1.1.

9. A composition as in claim 1 wherein said component (D) is present in the amount of about 10 to about 20% by weight, and comprises sodium perborate monohydrate.

10. A composition as in claim 1 containing less than about 2% by weight of water.

11. The process of manufacturing a phosphate-free washing composition in liquid to paste form, comprising:

(1) providing (A) about 20 to about 35% by weight of a tenside component which comprises (A1) about 1 to about 4% by weight of an anionic tenside selected from the group consisting of a sulphonate and a soap, (A2) about 16 to about 34% by weight of a nonionic tenside having a maximum setting point of about 10° C.;

(2) dispersing in said component (A) the following components, (B) about 10 to about 35% by weight of a builder salt which is capable of complexing or binding alkaline earth metal ions;

(C) about 15 to about 40% by weight of sodium metasilicate;

(D) about 8 to about 25% by weight of a per-salt bleaching agent;

(E) up to about 15% by weight of conventional detergent ingredients; and (F) less than about 3% by weight of water, with the proviso that the sum of components B+C is equal to about 30 to about 60% by weight, all weights being based on the weight of said composition; and (3) grinding the resulting dispersion so that the particle size of the dispersed solids is reduced to from about 5 to about 80 microns and the dispersion becomes homogenized.

12. The process as in claim 11 wherein said grinding step is conducted in a colloid mill.

13. The process as in claim 11 wherein said grinding step is conducted in a roller mill.

14. The process as in claim 11 wherein the particle size of the dispersed solids is reduced to from about 10 to about 50 microns.

15. The process as in claim 11 wherein the content of dispersed solids having a particle size larger than 80 microns is less than about 20% by weight.

* * * * *